US011628956B2

(12) United States Patent
Antonioli et al.

(10) Patent No.: US 11,628,956 B2
(45) Date of Patent: Apr. 18, 2023

(54) DOSING UNIT, A DOSING METHOD, AND A MACHINE FOR PRODUCING UNIT DOSE ARTICLES

(71) Applicant: Fameccanica.Data S.p.A., San Giovanni Teatino (IT)

(72) Inventors: Matteo Antonioli, San Giovanni Teatino (IT); Oscar Centorame, San Giovanni Teatino (IT); Diego Gualtieri, San Giovanni Teatino (IT); Francesco D'Aponte, San Giovanni Teatino (IT)

(73) Assignee: Fameccanica.Data S.p.A., San Giovanni Teatino (IT)

( * ) Notice: Subject to any disclaimer, the term of this patent is extended or adjusted under 35 U.S.C. 154(b) by 0 days.

(21) Appl. No.: 17/713,337

(22) Filed: Apr. 5, 2022

(65) Prior Publication Data

US 2022/0324594 A1 Oct. 13, 2022

(30) Foreign Application Priority Data

Apr. 7, 2021 (EP) ..... 21167133

(51) Int. Cl.

| | |
|---|---|
| ***B65B 39/14*** | (2006.01) |
| ***B65B 3/32*** | (2006.01) |
| ***B65B 3/12*** | (2006.01) |
| ***B65B 3/02*** | (2006.01) |
| ***B65B 9/04*** | (2006.01) |
| ***B65B 47/02*** | (2006.01) |

(52) U.S. Cl.

CPC ..... *B65B 3/323* (2013.01); *B65B 3/022* (2013.01); *B65B 3/12* (2013.01); *B65B 3/326* (2013.01); *B65B 9/042* (2013.01); *B65B 39/14* (2013.01); *B65B 39/145* (2013.01); *B65B 47/02* (2013.01); *B65B 2009/047* (2013.01)

(58) Field of Classification Search

CPC ..... B65B 39/00; B65B 39/14; B65B 39/145; B65B 39/001; B65B 3/04; B65B 3/022; B65B 3/12; B65B 3/305; B65B 3/323; B65B 3/326; B65B 3/34; B65B 9/042; B65B 47/02; B65B 2009/047

See application file for complete search history.

(56) References Cited

U.S. PATENT DOCUMENTS 2,311,923 A * 2/1943 Lautmann ..... A61K 9/4833 514/552
2,653,430 A * 9/1953 Vogt ..... B65B 25/06 53/372.8

(Continued)

FOREIGN PATENT DOCUMENTS

DE 102013109969 A1 3/2015

OTHER PUBLICATIONS

European Search report dated Aug. 27, 2021. 7 pages.

*Primary Examiner* — Nicolas A Arnett
(74) *Attorney, Agent, or Firm* — RMCK Law Group PLC

(57) ABSTRACT

A dosing unit for a machine for producing unit dose articles includes a plurality of nozzles carried by respective movable elements and associated to respective dosing chambers, a plurality of plungers reciprocally movable into respective dosing chambers between respective retracted and advanced positions, and a rotary fluid distributor including at least one stationary inlet and a plurality of movable outlets fluidically connected to the respective dosing chambers.

12 Claims, 5 Drawing Sheets

(56) References Cited

U.S. PATENT DOCUMENTS

| | | | | | |
|---|---|---|---|---|---|
| 2,761,605 | A * | 9/1956 | Pahl | B65B 39/001 | 141/147 |
| 3,087,517 | A * | 4/1963 | Genevieve | B65B 39/145 | 141/147 |
| 3,336,956 | A * | 8/1967 | Henry | B65B 3/10 | 141/144 |
| 3,371,461 | A * | 3/1968 | Aronson | B65B 39/145 | 53/511 |
| 4,033,093 | A * | 7/1977 | Mencacci | B65B 31/04 | 141/264 |
| 4,567,919 | A * | 2/1986 | Fogg | B65G 33/06 | 141/145 |
| 4,884,599 | A * | 12/1989 | Newman | B65B 1/30 | 141/10 |
| 5,174,088 | A * | 12/1992 | Focke | B65B 29/00 | 53/111 R |
| 5,494,085 | A * | 2/1996 | Zink | B65B 3/30 | 141/270 |
| 8,386,072 | B1 * | 2/2013 | Mihalik | B67C 3/026 | 700/239 |
| 10,023,333 | B2 * | 7/2018 | Corominas | B65B 39/001 | |
| 2015/0336692 | A1 * | 11/2015 | Brandt Sanz | C11D 17/042 | 53/450 |
| 2018/0346306 | A1 * | 12/2018 | Carpino | F16K 11/085 | |
| 2018/0362193 | A1 * | 12/2018 | Howell, II | B65B 39/007 | |
| 2022/0332452 | A1 * | 10/2022 | Centorame | B65B 57/00 | |

* cited by examiner

DOSING UNIT, A DOSING METHOD, AND A MACHINE FOR PRODUCING UNIT DOSE ARTICLES

CROSS-REFERENCE TO RELATED APPLICATION

This application claims priority to European Patent Application No. 21167133.4 filed Apr. 7, 2021. The disclosure of the above application is incorporated herein by reference in its entirety.

FIELD OF THE INVENTION

The present invention relates to a dosing unit and to a dosing method for dosing a fluid product.

The invention was developed in particular in view of its application to the production of unit dose articles, e.g., unit dose articles filled with household care compositions, such as laundry detergents, dishwasher detergents, softeners, and other compositions used in household appliances.

The invention relates in particular to the production of detergent pods formed by a one or more fluid compositions enclosed between two water-soluble films.

In the following description, reference will be made to this specific field without however losing generality.

PRIOR ART

Laundry and dishwasher detergent pods are water-soluble pouches containing highly concentrated laundry detergents, softeners, and other laundry products. Detergent pods are becoming increasingly popular in view of the ease of use for the user and the positive impact on sustainability as they are a way to reduce wasted use of powdered and liquid detergent by having precise measurements for a load.

Detergent pods are generally produced by forming cavities in a first water-soluble film, filling the cavities with fluid compositions, applying a second water-soluble film over the first water-soluble film, and joining to each other the first and second water-soluble films so as to seal the compositions between the two water-soluble films.

WO2015179584-A1 discloses methods and systems for dispensing a composition into the cavities of a web that continuously moves in a machine direction, wherein a water-soluble web having a plurality of cavities is disposed on a continuously moveable surface, wherein a filling apparatus comprising a plurality of nozzles is positioned to dispense a household care composition into the cavities while said nozzles move from a first position to a second position, and wherein said nozzles return to said first position after having filled the respective cavities.

An alternate reciprocating dispensing process, where one or more nozzles move together with the cavities to be filled and return to a start position after having filled the cavities, improves efficiency as compared to a start and stop filling process, where the cavities stop under a nozzle while being filled. However, after the nozzles fill one set of cavities, the nozzles must return to the start position before they begin filling the next cavities. This may limit the speed of the filling process and the number of cavities that can be filled in a given time period.

In an embodiment shown in FIG. 12B of WO2015179584-A1 the nozzles move with continuous motion on an endless surface, for example, a belt rotating surface. The nozzles move with the same speed as the cavities and in the same direction, such that each unfilled cavity is under the same nozzle for the duration of the dispensing step. After dispensing stops, the nozzles rotate and return to the first position, where they start dispensing the composition again into another unfilled cavity.

A continuous dispensing process where the nozzles move with continuous motion might improve efficiency as compared to an alternate reciprocating dispensing process but also has limitations. For example, the reversal of the motion of the nozzles can lead to an entry of air into the nozzles, with consequent possibility of dripping and contamination of the underlying web. A system with rotating nozzle requires a feeding system capable of feeding the nozzles during their motion and which can guarantee sufficient precision and repeatability of dosing.

OBJECT AND SUMMARY OF THE INVENTION

The object of the present invention is to provide a dosing unit and method for dosing a fluid product which overcome the problems of the prior art.

According to the present invention, this object is achieved by a dosing unit according to claim 1 and by a dosing method according to claim 8.

According to another aspect, the present invention relates to a machine for manufacturing unit dose articles according to claim 7.

The claims form an integral part of the technical disclosure provided here in relation to the invention.

BRIEF DESCRIPTION OF THE DRAWINGS

The present invention will now be described in detail with reference to the attached drawings, given purely by way of non-limiting example, wherein.

It should be appreciated that the attached drawings are schematic and various figures may not be represented in the same scale. Also, in various figures some elements may not be shown to better show other elements.

DETAILED DESCRIPTION

Figure 1:
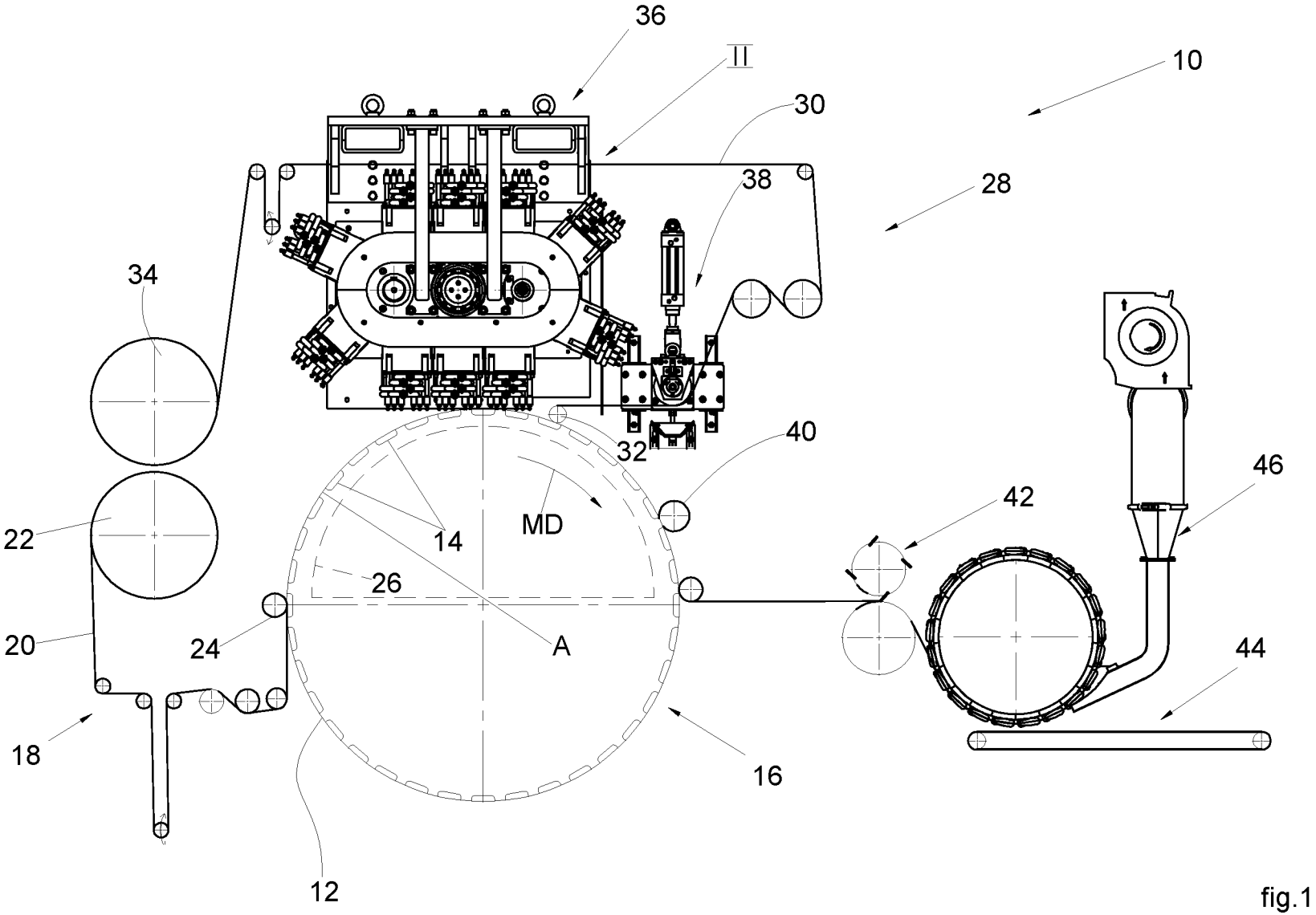
FIG. 1 is a schematic side view of a machine for producing unit dose articles according to the present invention.

With reference to FIG. 1, a machine for producing unit dose articles is indicated by the reference numeral 10.

The machine 10 comprises a movable surface 12 having a plurality of cavities 14, continuously movable in a machine direction MD. In the embodiment shown in FIG. 1 the movable surface 12 is formed by the outer circumferential surface of a wheel 16 rotating about a horizontal axis A. In a possible embodiment, the movable surface 12 may be formed by an outer surface of a closed-loop belt.

The machine 10 comprises a first feeding assembly 18 configured for feeding a first continuous water-soluble film 20 on the movable surface 12. The first continuous water-soluble film 20 is unwound from a first reel 22 and is supplied to the movable surface 12 at a first position 24.

The first continuous water-soluble film 20 is retained on the movable surface 12 as it moves in the machine direction MD. The first continuous water-soluble film 20 may be retained on the movable surface 12 by mechanical retention elements acting on lateral edges of the first continuous water-soluble film 20, e.g. by belts which retain the lateral edges of the first continuous water-soluble film 20 on the outer surface of the wheel 16.

The first continuous water-soluble film 20 is deformed into the cavities 14 of the movable surface 12 as it moves in the machine direction MD. The deformation of the first continuous water-soluble film 20 into the cavities 14 may be obtained by a suction retaining system comprising a plurality of holes open on the surfaces of the cavities 14 and fluidically connected to a stationary suction chamber 26 connected to a sub-atmospheric pressure source. The first continuous water-soluble film 20 is kept adherent to the walls of the cavities 14 by said suction retaining system, so that in the first continuous water-soluble film 20 a plurality of recesses are formed, having the same shape as the cavities 14.

The machine 10 comprises a second feeding assembly 28 configured for feeding a second continuous water-soluble film 30 on the movable surface 12 at a second position 32 located downstream of said first position 24 with respect to the machine direction MD. The second continuous water-soluble film 30 is unwound from a second reel 34.

The machine 10 comprises a dosing unit 36 configured for dispensing dosed quantities of at least one fluid composition into the recesses of the first continuous water-soluble film 20 placed into the cavities 14 of the movable surface 14. The dosing unit 36 is located in a position intermediate between the first position 24 and the second position 32. The dosing unit 36 fills the recesses of the first continuous water-soluble film 20 with one or more fluid compositions. After the recesses of the first continuous water-soluble film 20 have been filled with the fluid compositions, the second continuous water-soluble film 30 is applied over the first continuous water-soluble film 20, so as to enclose the dosed quantities of fluid compositions contained into the recesses between the first and second continuous water-soluble films 20, 30.

The machine 10 comprises a wetting unit 38 configured for wetting a surface of the second continuous water-soluble film 30 upstream of said second position 32. The wetting unit 38 comprises a wetting roller which is in contact with the surface of the second continuous water-soluble film 30 which will be put in contact with the first continuous water-soluble film 20. The first and second continuous water-soluble films 20, 30 are water-sealed to each other in respective contact areas which surround the recesses containing the dosed fluid compositions.

The machine 10 comprises a longitudinal cutter 40 and a transverse cutter 42 which cut the joining areas between the first and second continuous water-soluble films 20, 30 so as to form individual unit dose articles which are collected on an output conveyor 44. The scraps of the water-soluble films originated by the longitudinal and transverse cuts are removed by a scrap aspirator 46.

Figure 2:
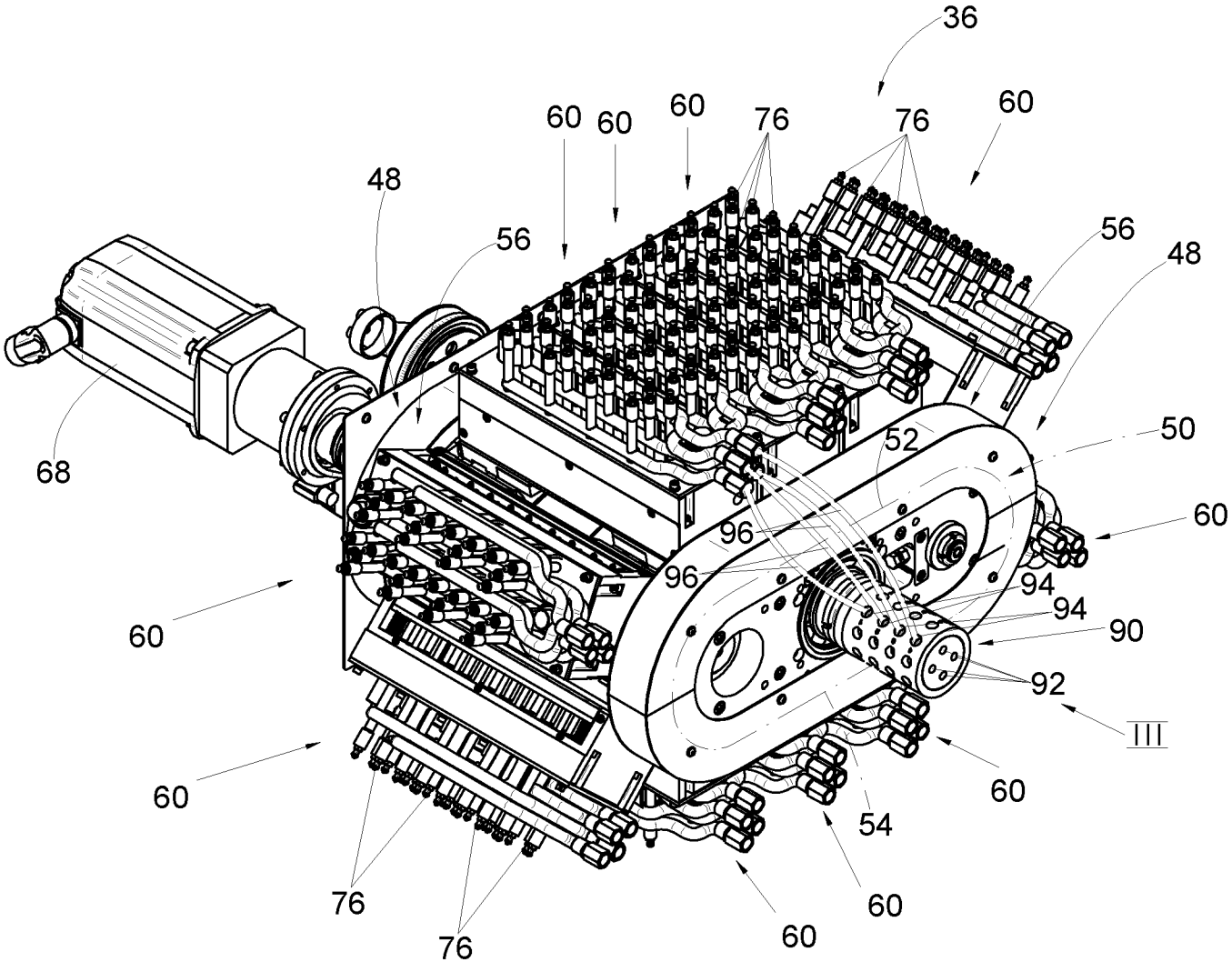
FIG. 2 is a perspective view of a dosing unit according to the present invention indicated by the arrow II in FIG. 1.
Figure 3:
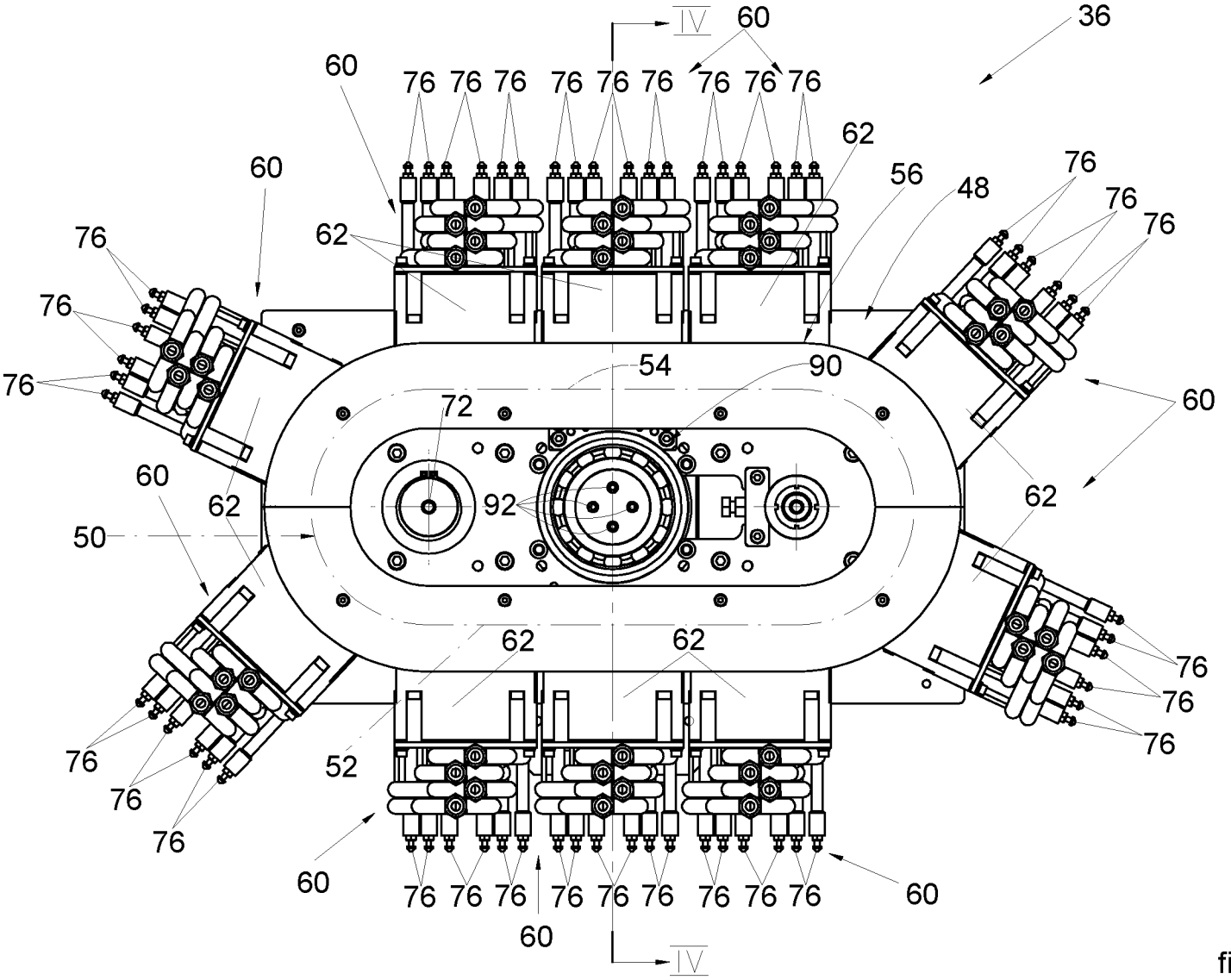
FIG. 3 is a front view of the dosing unit taken along the line III of FIG. 2.
Figure 4:
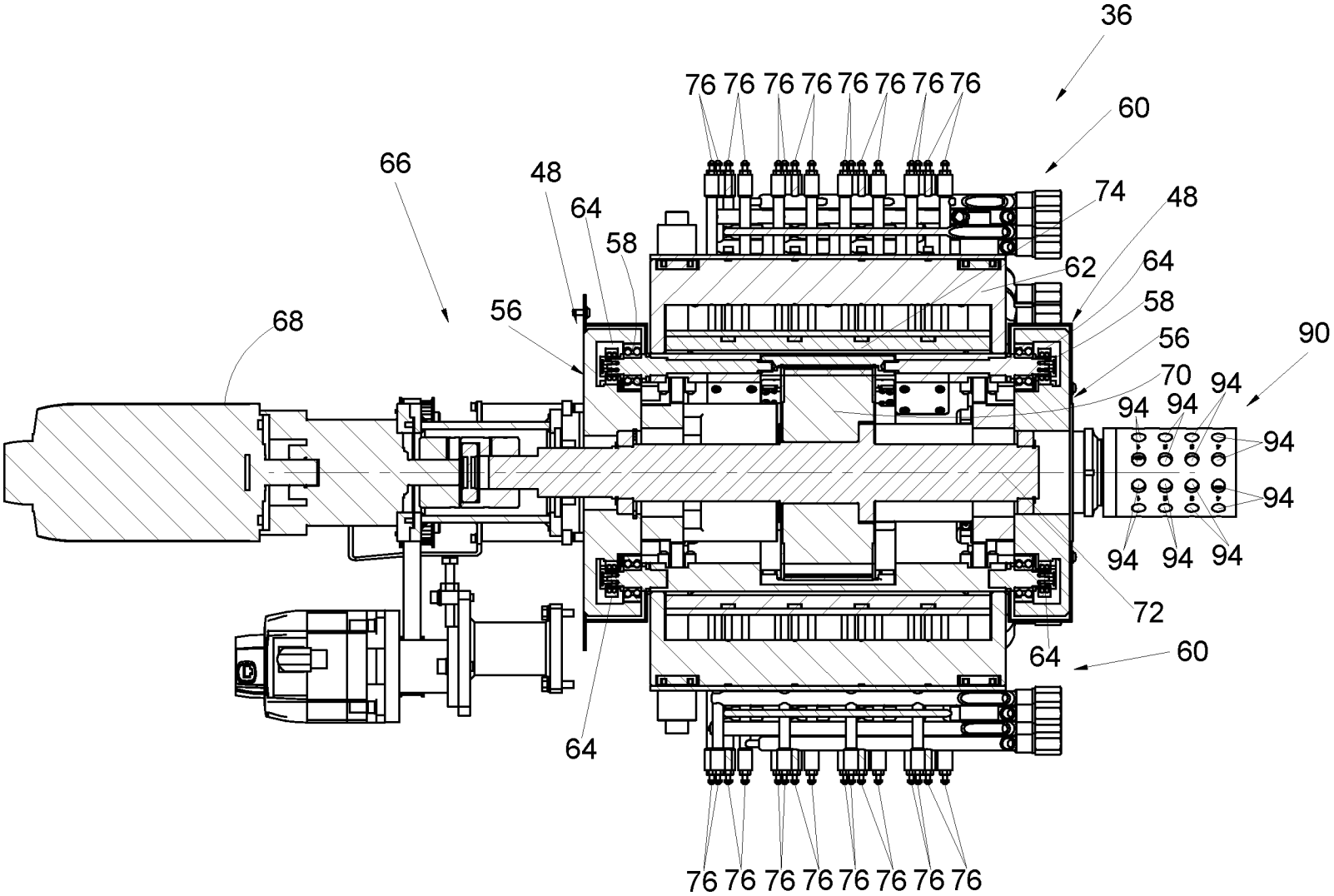
FIG. 4 is a cross-section taken along the line IV-IV of FIG. 3.

With reference to FIGS. 2-4 the dosing unit 36 comprises a stationary guide 48 defining a closed-loop guide path 50 having a lower section 52 and an upper section 54. The closed-loop guide path 50 may have a straight horizontal lower section 52, a straight horizontal upper section 54, and two arcuate sections each connecting to each other respective ends of the straight horizontal lower section 52 and straight horizontal upper section 54.

Figure 5:
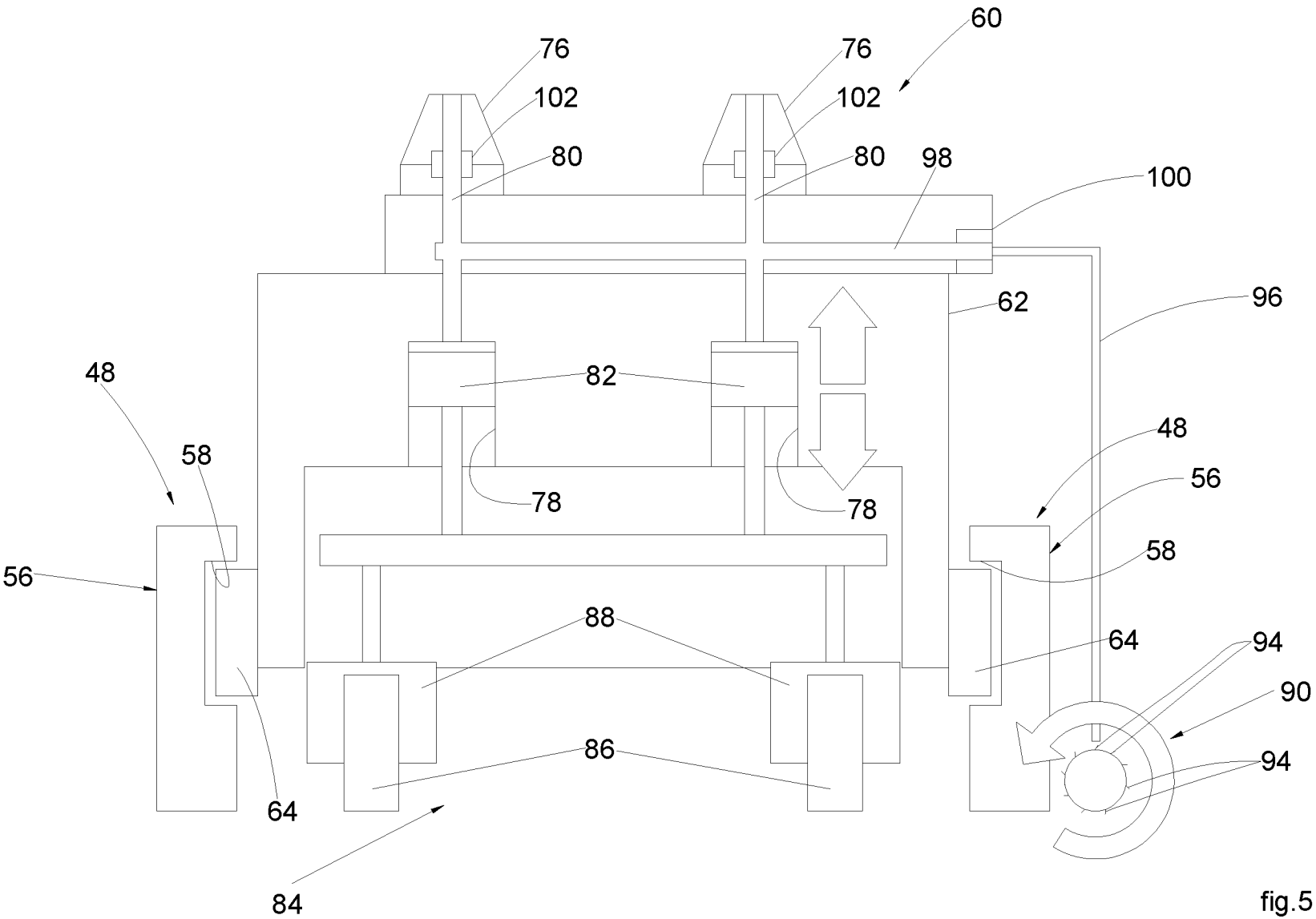
FIG. 5 is a schematic cross-section showing the fluid dosing system of the dosing unit of the present invention.

The stationary guide 48 may comprise two side plates 56 facing each other and spaced apart from each other in a horizontal direction. As shown in FIGS. 4 and 5, each side plate 56 may have a respective closed-loop guide slot 58 which defines said closed-loop guide path 50.

The dosing unit 36 comprises a plurality of movable elements 60 which are continuously movable along said stationary guide 48. Each movable element 60 comprises a body 62 carrying rollers 64 which engage the closed-loop guide slots 58 of the two side plates 56, so as to guide the respective movable element 60 along the closed-loop guide path 50.

With reference to FIG. 4, the dosing unit 36 comprises a transmission system 66 configured for continuously moving the movable elements 60 along said closed-loop path 50. The transmission system 66 may comprise a motor 68 connected to a toothed pulley 70 via a shaft 72, and a toothed belt 74 meshing with the toothed pulley 70 and connected to the bodies 62 of the movable elements 60.

With reference to FIG. 5, each movable element 60 comprises a plurality of nozzles 76 and a plurality of dosing chambers 78, carried by the body 62. Each dosing chamber 78 is fluidically connected to one or more nozzles 76 via a delivery line 80. In a possible embodiment, each nozzle 76 may be associated to a respective dosing chamber 78. The nozzles 76 face downward when the respective movable element 60 is moving along the lower section 52 of the closed-loop guide path 50 and face upward when the respective movable element 60 is moving along the upper section 54 of the closed-loop guide path 50.

With reference to FIG. 5, each movable element 60 comprises a plurality of plungers 82 reciprocally movable into respective dosing chambers 78 between respective retracted and advanced positions. The dosing unit 36 comprises a driving system 84 configured for moving said plungers 82 from the respective retracted position to the respective advanced position, and vice versa. More specifically, the driving system 84 moves the plungers 82 from the retracted position to the advanced position when the respective movable element 60 moves along the lower section 52 of the closed-loop guide path 50 and moves the plungers 82 from the advanced position to the retracted position when the movable element 60 moves along the upper section 54 of the closed-loop path 50.

In a possible embodiment, the driving system 84 comprises a stationary cam 86 cooperating with a plurality of cam-follower elements 88 connected to respective plungers 82. The profile of the stationary cam 86 is configured for moving the respective plungers 82 from the retracted position to the advanced position when the movable elements 60 are moving along the lower section 52 of the closed-loop guide path 50 and for moving the plungers 82 from the advanced position to the retracted position when the movable elements 60 are moving along the upper section 54 of the closed-loop guide path 50.

The driving system 84 comprising a stationary cam 86 cooperating with a plurality of cam-follower elements 88 is only one of many different possibilities for driving the plungers 82. For example, the plungers 82 may be driven by remotely controlled actuators which move the plungers 82 in accordance with a predetermined program as a function of the position of the movable elements 60 along the closed-loop guide path 50.

With reference to FIGS. 2, 4 and 5, the dosing unit 36 comprises a rotary fluid distributor 90 comprising at least one stationary inlet 92 and a plurality of movable outlets 94 connected to respective dosing chambers 78 via respective flexible tubes 96. Only a few of the flexible tubes 96 are shown in FIG. 2. In the other figures the flexible tubes 96 are not shown for not impairing understanding of the figures.

The rotary fluid distributor 90 may have a plurality of stationary inlets (for instance four stationary inlets 92) connected to respective fluid supply pumps, which supply different fluid compositions. Each stationary inlet 92 is connected to a plurality of movable outlets 94. The rotary part of the rotary fluid distributor 90 may be driven in rotation by a motor.

With reference to FIG. 5, each flexible tube 96 is fluidically connected to one or more dosing chambers 78 via supply ducts 98 formed in the bodies 62 of the movable elements 60. The fluid in the supply ducts 98 fills the dosing chambers 78 when the plungers 82 move from the advanced position to the retracted position.

With reference to FIG. 5, in a possible embodiment the dosing chambers 78 of each movable element 60 are connected to the respective movable outlets 94 of the rotary fluid distributor 90 by respective one-way valves 100 which allows the fluid to flow from the respective movable outlet 94 of the rotary fluid distributor 90 to the respective dosing chambers 78 and prevents the fluid to flow from the dosing chambers 78 to the respective movable outlets 94 of the rotary fluid distributor 90.

With reference to FIG. 5, in a possible embodiment each of the nozzles 76 has a respective stop valve 102 which is opened to allow the fluid to flow from the respective dosing chamber 78 to the nozzle 76 when the fluid pressure in the delivery line 80 is greater than a predetermined threshold and is closed when the fluid pressure in the delivery line 80 is lower than said predetermined threshold.

In operation, the movable elements 60 of the dosing unit 36 move continuously along the closed-loop guide path 50 and the wheel 16 rotates continuously around the horizontal axis A.

When the movable elements 60 move along the upper section 54 of the closed-loop path 50, the profile of the cam 86 moves the plungers 82 from the advanced position to the retracted position, and vice versa. The fluid compositions supplied under pressure in the supply ducts 98 fill the dosing chambers 78. The fluid compositions cannot exit from the nozzles 76 because the pressure of the fluid in the supply ducts 98 is below the opening threshold of the stop valves 102.

The speed and position of the movable elements 60 is synchronized with the speed and position of the wheel 16, so that when the movable elements 60 move along the lower section of the closed-loop guide path 50 each nozzle 76 faces a respective cavity 14 of the movable surface 12.

When the movable elements 60 move along the lower section 52 of the closed-loop path 50, the profile of the cam 86 moves the plungers 82 from the retracted position to the advanced position, thereby pressurizing the fluid in the delivery lines 80 at a pressure greater than the opening threshold of the stop valves 102. The fluid compositions are therefore delivered from the nozzles 76 and fill the respective recesses of the first continuous water-soluble film 20 located into the cavities 14 of the movable surface 16. The one-way valves 100 prevent the fluid to flow back to the rotary fluid distributor 90.

The plungers 82 may start the aspiration phase at the end of the travel of the nozzles 76 along the lower section 52 of the closed-loop guide path 50 so that there is no dripping of fluid from the nozzles 76 when the nozzles 76 start moving away from the respective cavities 14. The stop valves 102 prevent entry of air into the nozzles 76 and the dosing chambers 78 during the aspiration step.

The dosing unit 36 carries out a precise volumetric delivery of the fluid compositions, with a constant volume of the fluid composition delivered in each travel of the nozzles 76 along the lower section 52 of the closed-loop guide path 50. The dosing unit 36 can therefore guarantee sufficient precision and repeatability of the dosing. The reversal of the motion of the nozzles does not lead to entry of air into the nozzles. The dosing unit 36 prevents dripping and contamination of the underlying water-soluble film.

Of course, without prejudice to the principle of the invention, the details of construction and the embodiments can be widely varied with respect to those described and illustrated, without thereby departing from the scope of the invention as defined by the claims that follow.

The invention claimed is:

1. A dosing unit for a machine for producing unit dose articles, comprising::

a stationary guide defining a closed-loop guide path having a lower section and an upper section, a plurality of movable elements movable along said stationary guide, a transmission system configured for continuously moving said plurality of movable elements along said closed-loop guide path, a plurality of nozzles carried by respective movable elements and associated to respective dosing chambers, a plurality of plungers reciprocally movable into respective dosing chambers between respective retracted and advanced positions, a rotary fluid distributor comprising at least one stationary inlet and a plurality of movable outlets fluidically connected to respective dosing chambers, and a driving system configured for moving said plurality of plungers from the retracted position to the advanced position when the respective movable elements move along said lower section of the closed-loop guide path and for moving said plurality of plungers from the advanced position to the retracted position when the respective movable elements move along said upper section of the closed-loop guide path.

2. The dosing unit of claim 1, wherein said driving system comprises at least one stationary cam cooperating with a plurality of cam-follower elements connected to respective plungers and configured for moving the respective plungers between said retracted position and advanced position, and vice versa.

3. The dosing unit of claim 1, wherein said dosing chambers are connected to the plurality of movable outlets of said rotary fluid distributor through one-way valves which allow a fluid to flow from the plurality of movable outlets of the rotary fluid distributor to the dosing chambers and prevent the fluid to flow from the dosing chambers to the plurality of movable outlets of the rotary fluid distributor.

4. The dosing unit of claim 1, wherein:

each of said plurality of nozzles is connected to a respective delivery chamber through a respective delivery line and wherein a respective stop valve is arranged in said respective delivery line, and said stop valve is open to allow a fluid to flow from the respective dosing chamber to the respective nozzle when a fluid pressure in the respective delivery line is greater than a predetermined threshold and is closed when the fluid pressure in the respective delivery line is lower than said predetermined threshold.

5. The dosing unit of claim 1, wherein each of said movable elements carries a plurality of nozzles, each of which is connected to a respective dosing chamber.

6. The dosing unit of claim 1, wherein said closed-loop guide path has a straight horizontal lower section, a straight horizontal upper section, and two arcuate sections each connecting to each other respective ends of the straight horizontal lower section and straight horizontal upper section.

7. A machine for producing unit dose articles, comprising:

a movable surface having a plurality of cavities, continuously movable in a machine direction, a first feeding assembly configured for feeding a first continuous water-soluble film on said movable surface at a first position, a retaining system configured for retaining said first continuous water-soluble film adherent to said cavities as it moves in said machine direction, a dosing unit located downstream of said first position and configured for dispensing dosed quantities of at least one fluid composition into said cavities, a second feeding assembly configured for feeding a second continuous water- soluble film on said movable surface at a second position located downstream of said dosing unit so as to enclose said dosed quantities of at least one fluid composition between said first and second continuous water-soluble films, and a wetting unit configured for wetting a surface of said second continuous water-soluble film upstream of said second position, wherein said dosing unit comprises:

a stationary guide defining a closed-loop guide path having a lower section and an upper section, a plurality of movable elements movable along said stationary guide, a transmission system configured for continuously moving said plurality of movable elements along said closed-loop guide path, a plurality of nozzles carried by respective movable elements and associated to respective dosing chambers, a plurality of plungers reciprocally movable into the respective dosing chambers between respective retracted and advanced positions, a rotary fluid distributor comprising at least one stationary inlet and a plurality of movable outlets fluidically connected to the respective dosing chambers, and a driving system configured for moving said plurality of plungers from the retracted position to the advanced position when the respective movable elements move along said lower section of the closed-loop guide path and for moving said plurality of plungers from the advanced position to the retracted position when the respective movable elements move along said upper section of the closed-loop guide path.

8. A method for dosing fluid products, comprising:

continuously moving a plurality of movable elements along a closed-loop guide path having a lower section and an upper section, providing on said plurality of movable elements a plurality of nozzles associated to respective dosing chambers, providing a plurality of plungers reciprocally movable into respective dosing chambers between respective retracted and advanced positions, supplying at least one fluid composition to said dosing chambers through a rotary fluid distributor comprising at least one stationary inlet and a plurality of movable outlets connected to the respective dosing chambers, and moving said plurality of plungers from the retracted position to the advanced position while the respective movable elements move along said lower section of the closed-loop guide path and moving said plurality of plungers from the advanced position to the retracted position when the respective movable elements move along said upper section of the closed-loop guide path.

9. The method of claim 8, wherein said plurality of plungers are reciprocally moved between said retracted position and advanced position, and vice versa, by a stationary cam cooperating with a plurality of cam-follower elements connected to respective plungers.

10. The method of claim 8, comprising providing a unidirectional flow of fluid directed from said plurality of movable outlets of said rotary fluid distributor to the respective dosing chambers.

11. The method of claim 8, comprising stopping the flow of fluid directed from said respective dosing chambers to said plurality of nozzles when a pressure of the fluid is below a predetermined threshold.

12. The method of claim 11, comprising supplying the fluid from said plurality of movable outlets of said rotary fluid distributor to the respective dosing chambers at a pressure lower than said predetermined threshold.

* * * * *